US008162474B2

(12) United States Patent
Arai et al.

(10) Patent No.: US 8,162,474 B2
(45) Date of Patent: Apr. 24, 2012

(54) IMAGE FORMING APPARATUS

(75) Inventors: Hitoshi Arai, Ibaraki-ken (JP); Kenji Oshima, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 877 days.

(21) Appl. No.: 12/213,038

(22) Filed: Jun. 13, 2008

(65) Prior Publication Data

US 2009/0035040 A1 Feb. 5, 2009

(30) Foreign Application Priority Data

Aug. 3, 2007 (JP) ..... P2007-203062

(51) Int. Cl.
*B41J 2/01* (2006.01)

(52) U.S. Cl. ..... 347/104; 347/101; 347/102

(58) Field of Classification Search ..... None
See application file for complete search history.

(56) References Cited

U.S. PATENT DOCUMENTS

2005/0254872 A1* 11/2005 Nonaka et al. ..... 399/401

FOREIGN PATENT DOCUMENTS

| | | |
|---|---|---|
| JP | 2000-272114 A | 10/2000 |
| JP | 2005-220296 | 8/2005 |
| JP | 2006-131415 A | 5/2006 |
| JP | 2006-264828 | 10/2006 |

OTHER PUBLICATIONS

The Official Action issued on Jan. 10, 2012 in the counterpart Japanese application No. 2007-203062, two pages.

* cited by examiner

*Primary Examiner* — Matthew Luu
*Assistant Examiner* — Kendrick Liu
(74) *Attorney, Agent, or Firm* — The Nath Law Group; Jerald L. Meyer; Stanley N. Protigal

(57) ABSTRACT

An image forming apparatus includes a circulating transfer path for transferring a sheet. The image forming apparatus is capable of forming images on both surfaces of the sheet by: transferring the sheet having an image formed on a first surface thereof along the circulating transfer path; and forming another image on a second surface of the sheet after the transfer. The circulating transfer path is utilized for securing time taken for the sheet having an image formed thereon to dry.

11 Claims, 10 Drawing Sheets

FIG. 4

| PRINTING ORDER | PREDETERMINED ONE SURFACE | FIRST CIRCULATION | SECOND CIRCULATION |
|---|---|---|---|
| 1 | 1 | 1 | 1 |
| 2 | 2 | | |
| 3 | 3 | 2 | |
| 4 | 4 | | 2 |
| 5 | 5 | 3 | |
| 6 | 6 | FIRST CIRCULATION PRINTED SHEET (1) | FIRST CIRCULATION PRINTED SHEET (1) |
| 7 | 7 | 4 | 3 |
| 8 | 8 | FIRST CIRCULATION PRINTED SHEET (2) | |
| 9 | 9 | 5 | FIRST CIRCULATION PRINTED SHEET (2) |
| 10 | 10 | FIRST CIRCULATION PRINTED SHEET (3) | 4 |
| 11 | 11 | 6 | SECOND CIRCULATION PRINTED SHEET (1) |
| 12 | 12 | FIRST CIRCULATION PRINTED SHEET (4) | FIRST CIRCULATION PRINTED SHEET (3) |
| 13 | 13 | 7 | 5 |
| 14 | 14 | FIRST CIRCULATION PRINTED SHEET (5) | SECOND CIRCULATION PRINTED SHEET (2) |
| 15 | 15 | 8 | FIRST CIRCULATION PRINTED SHEET (4) |
| 16 | 16 | FIRST CIRCULATION PRINTED SHEET (6) | 6 |
| 17 | 17 | 9 | SECOND CIRCULATION PRINTED SHEET (3) |
| 18 | 18 | FIRST CIRCULATION PRINTED SHEET (7) | FIRST CIRCULATION PRINTED SHEET (5) |

IMAGE FORMING APPARATUS

BACKGROUND OF THE INVENTION

1. Field of the Invention

The present invention relates to an image forming apparatus, and particularly to an apparatus that circulates and transfers a sheet having an image formed thereon so as to dry the sheet.

2. Description of the Related Art

In recent years, in an image forming apparatus (an ink-jet image forming apparatus) that forms an image on a sheet of paper by an ink-jet method, use of an aqueous ink containing a large amount of water therein has become the mainstream. In this regard, a higher proportion of water contained in an ink causes a sheet of ordinary paper to be likely to be curled to a larger extent when a print is made on the sheet, and may result in failures as follows. Specifically, jamming of sheets may occur during transfer of the sheets, or alignment of the sheets having been discharged may be deteriorated. In order to prevent such failures, it is necessary to employ such a measure as providing certain physical means for correcting the curling (an apparatus or the like that corrects the curling) to the image forming apparatus.

On the other hand, there is a known ink that is an aqueous ink but capable of reducing an occurrence of the curling of sheets, as described in Japanese Patent Application Publication No. 2005-220296. However, it is still inevitable that a sheet is curled due to the water content in the ink components on the sheet immediately after printing. Particularly in a high-speed ink-jet image forming apparatus, for example, with a print speed of 120 ppm (that is, capable of recording images on 120 sheets of paper in one minute), a time interval between two print sheets (a time interval from the time of printing a sheet to the time of printing the next sheet) is very short. For this reason, the curling of the sheet immediately after the printing is not negligible.

In view of the above problem, an image recording apparatus (an image forming apparatus) having the following configuration has been disclosed in Japanese Patent Application Publication No. 2006-264828. This image recording apparatus employs an ink-jet system, and includes a transfer belt that transfers a sheet during the image formation. In this image recording apparatus, the curling of a sheet immediately after printing is suppressed by changing a position at which a sheet having an image formed thereon is separated off the transfer belt. In the normal operation of the image recording apparatus described in Japanese Patent Application Publication No. 2006-264828, a sheet is separated off the transfer belt immediately after image formation on the sheet by ink-jetting is completed. However, in a case where a sheet which does not quickly dry is used, after image formation on the sheet by the ink-jet method is completed, the sheet is transferred as it is to a certain extent by the transfer belt, and thereafter is separated off the transfer belt.

The image recording apparatus described in Japanese Patent Application Publication No. 2006-264828 is capable of preventing the curling of a sheet immediately after an image is formed on the sheet. However, since the image recording apparatus requires additionally a mechanism for changing a position at which a sheet having an image formed thereon is separate off the transfer belt, there is a problem that the structure of the apparatus is complicated.

SUMMARY OF THE INVENTION

The present invention has been made for the purpose of solving the above-described problems, and it is an object of the present invention to provide an image forming apparatus capable of preventing, with a simple configuration, the curling of a sheet having an image formed thereon.

To achieve the above object, a first aspect of the present invention is an image forming apparatus capable of forming images on both surfaces of a sheet by: transferring a sheet having an image formed on a first surface of the sheet along a circulating transfer path; and forming another image on a second surface of the sheet after the transfer, wherein the circulating transfer path is utilized for securing time taken for the sheet having an image formed on the sheet to dry.

To achieve the above object, a second aspect of the present invention is an image forming apparatus comprising: a paper feed unit configured to feed sheets stored in a paper storage section one by one to a registration section; an image forming unit including an image forming section and a transfer section, and being configured to form an image on a surface of each of the sheets by using the image forming section, while transferring the sheets one by one by using the transfer section, the sheets being fed by the paper feed unit and then sent from the registration section; a circulating transfer unit configured to transfer the sheets each having an image formed on each sheet by the image forming unit to the registration section one by one; a paper discharge unit configured to discharge the sheets each having an image formed on each sheet by the image forming unit one by one; and a control unit configured to control whether to perform any one of a direct paper discharge operation and a circulation paper discharge operation in accordance with an image forming condition for the sheets, the direct paper discharge operation being an operation in which the sheets each having an image formed on each sheet by the image forming unit are discharged by the paper discharge unit without being circulated by the circulating transfer unit, the circulation paper discharge operation being an operation in which, after being transferred by the circulating transfer unit, the sheets each having an image formed on each sheet by the image forming unit are transferred again by the transfer section of the image forming unit without image formation being performed by the image forming section of the image forming unit and then are discharged by the paper discharge unit.

The circulating transfer unit may include a paper transfer section. And upon images being formed on a group of a plurality of sheets in the circulation paper discharge operation, the control unit may control a timing of paper-feeding performed by the paper feed unit, so that the sheets are transferred efficiently without interference of the sheets with each other in the transfer section of the image forming unit, when the sheets having been transferred by the paper transfer section of the circulating transfer unit are fed to the image forming unit.

Upon the images being formed on the group of the plurality of sheets in the circulation paper discharge operation, the control unit may control a timing of paper-feeding performed by the paper feed unit, so that the sheets are transferred efficiently without interference of the sheets with each other in the transfer section of the image forming unit, after a start of the paper-feeding by the paper feed unit, and until the sheets having been transferred by the circulating transfer unit start to be fed to the image forming unit.

Upon the images being formed on the group of the plurality of sheets in the circulation paper discharge operation, the control unit may control a transfer speed of the sheets transferred by the circulating transfer unit, so that the sheets are transferred efficiently without interference of the sheets with each other in the transfer section of the image forming unit, after a completion of the paper-feeding by the paper feed unit, and while the sheets having been transferred by the circulating transfer unit are fed to the image forming unit.

The circulating transfer unit may include: a switchback section on a way of the paper transfer section, the switchback section being configured to turn upside down each sheet so that an image is formed on each of both surfaces of the sheet; and a shortcut paper transfer section in a vicinity of an entrance and an exit, for the sheets, of the switchback section, the shortcut paper transfer section bypassing the switchback section to shortcut.

The image forming unit may perform the image formation by ink-jetting; and the image forming condition in the image forming unit may be a condition regulating a degree of dryness of ink transferred onto the sheets by the ink-jetting.

Upon images being formed on a group of a plurality of sheets by the circulation paper discharge operation, a number of times of circulation required for a sheet having a worst degree of dryness of the ink among the sheets may be set to be a number of times of circulation for each sheet in the circulation paper discharge operation.

The above configurations make it possible to provide an image forming apparatus capable of preventing, with a simple configuration, the curling of a sheet having an image formed thereon.

BRIEF DESCRIPTION OF THE DRAWINGS

FIG. 4 is a table showing an example of paper-feeding control, and showing a paper-feeding state and an image-forming state in the image forming apparatus.

DETAILED DESCRIPTION OF THE EMBODIMENTS

Figure 1:
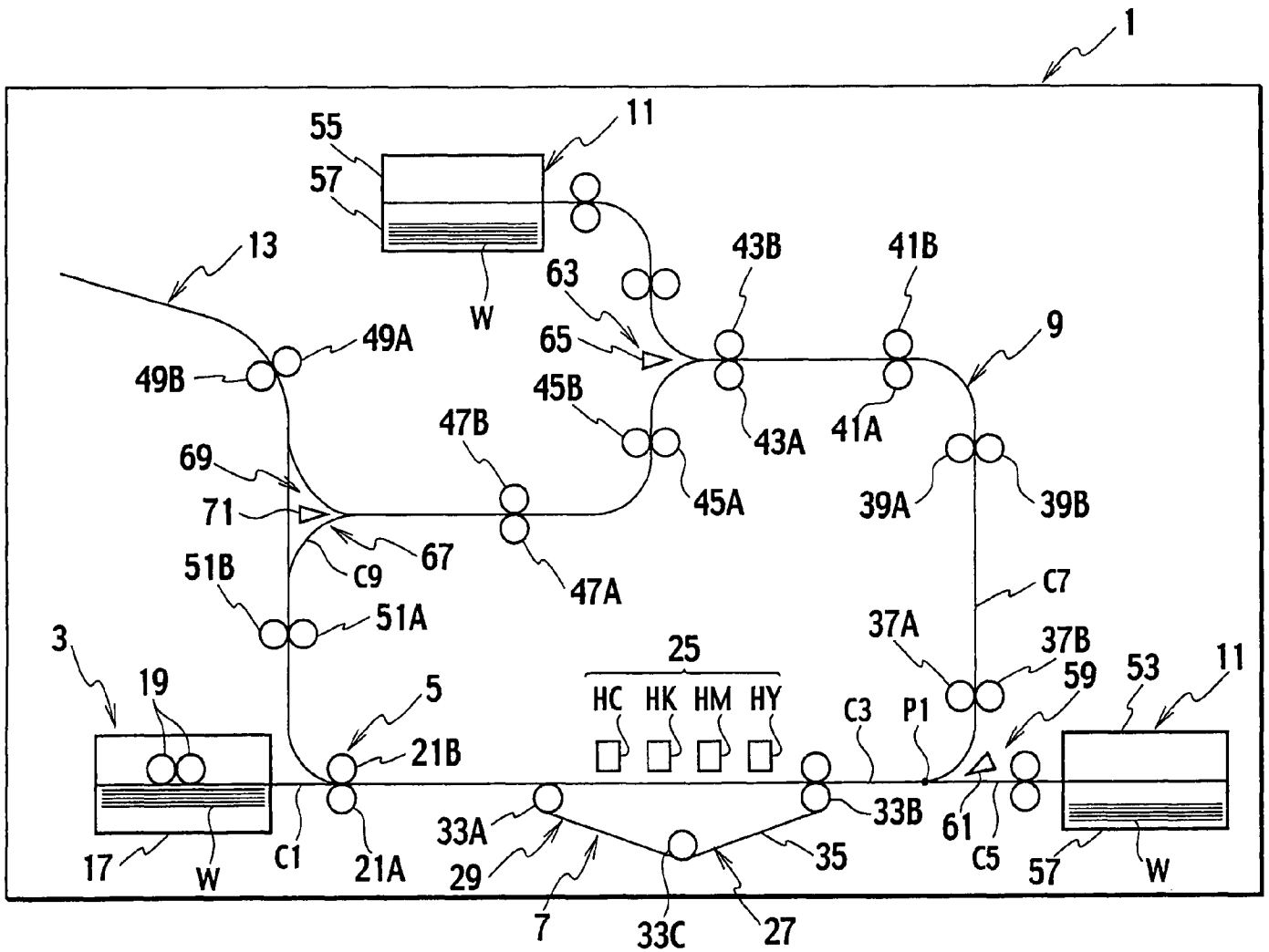
FIG. 1 is a diagram showing a schematic configuration of an image forming apparatus according to a first embodiment of the present invention.

Hereinafter, embodiments of the present invention will be described with reference to the drawings. In the following description of the drawings, the same or similar reference numerals are given to the same or similar elements.

(First Embodiment)

Figure 2:
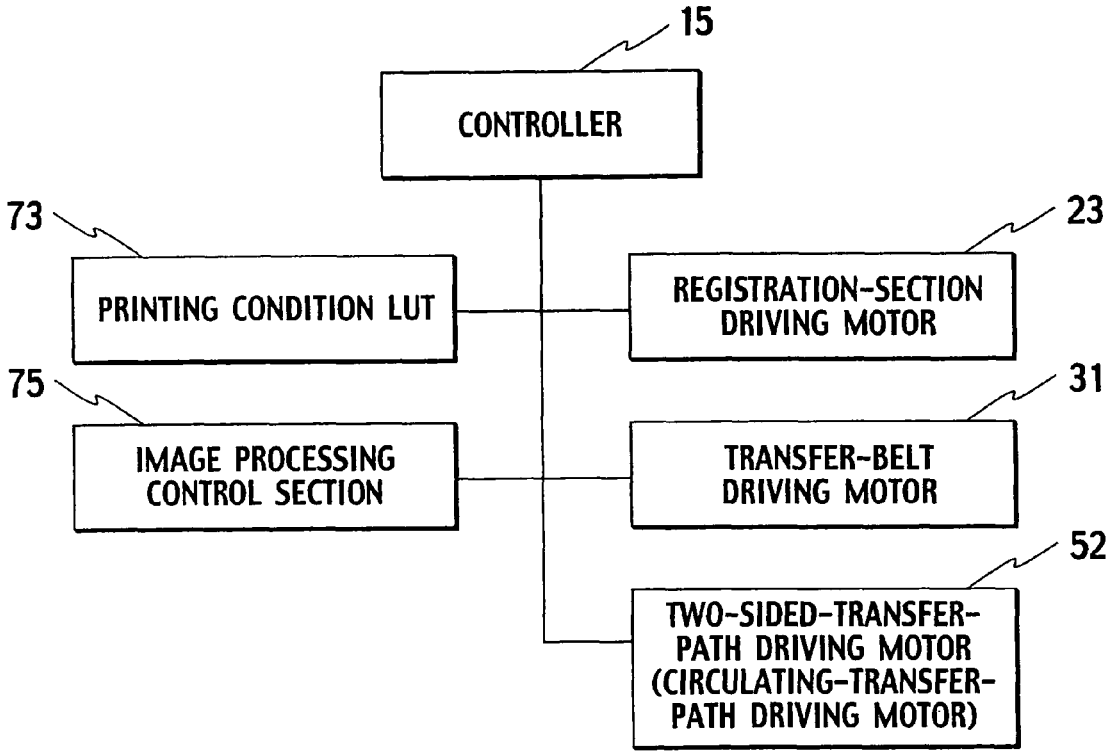
FIG. 2 is a block diagram showing a control system of the image forming apparatus.

FIG. 1 is a diagram showing a schematic configuration of an image forming apparatus 1 according to a first embodiment of the present invention. FIG. 2 is a block diagram showing a control system of the image forming apparatus 1.

The image forming apparatus 1 is configured to be capable of forming an image on one surface of each one of a group of multiple sheets W successively one by one, and also capable of forming images on both surfaces of each one of the group of multiple sheets W successively one by one. In other words, the image forming apparatus 1 can be used in a mode of forming images on both of the front and back surfaces of each sheet W, and also can be used in a mode of forming an image only on one surface (for example, the front surface) of each sheet W.

The image forming apparatus 1 includes a paper feed unit 3, a registration section 5, an image forming unit 7, a circulating transfer unit 9, a paper discharge unit 11, a switchback section 13, all of which are arranged on a transfer path of the sheets W, as in the case of a related image forming apparatus of the same type. The image forming apparatus 1 also includes a control unit (controller) 15.

The paper feed unit 3 is configured to separate each sheet W (single sheet) from rectangular sheets (multiple sheets) W, and to feed the sheets W to the registration section 5 one by one from the sheet W placed on top of a stack of the sheets W. Here the sheets W are stacked and stored in a paper storage section 17 like a tray. The paper feed unit 3 includes a pickup roller 19 coming into contact with an upper surface of the sheet W stacked and placed on top of the stack, and feeds the sheets W to the registration section 5 in the following manner. The pickup roller 19 is rotationally driven by an actuator (not illustrated), such as a motor, which is driven by control of the controller 15, so that each sheet W is transferred along a paper transfer path (a paper transfer path provided between the paper storage section 17 and the registration section 5) C1.

The sheets W may be, not only sheets of paper made from pulp, but also sheets, such as films made of a synthetic resin or the like, on which film a picture and a character can be formed by printing or the like.

The registration section 5 is provided so as to stop, for example, temporarily, the transfer of the sheets W fed from the paper feed unit 3, to correct the oblique passing of the sheets W, and to then send the sheets W to the image forming unit 7. The registration section 5 includes register rollers 21A and 21B which are in facing contact with each other. The registration section 5 is configured to sandwich each sheet W between the register rollers 21A and 21B, and then to send the sheet W to the image forming unit 7 with at least one of the register rollers 21A and 21B being rotationally driven by an actuator, such as a motor 23 (see FIG. 2), which is driven by control of the controller 15.

The image forming unit 7 includes an image forming section 25 and a transfer section 27. The sheets W are sequentially fed by the paper feed unit 3 and then sent from the registration section 5. The image forming unit 7 transfers the sheets W one by one by using the transfer section 27 at a first transfer speed in a direction in which the sheets W move apart from the registration section 5, while forming an image on a surface of each sheet W by using the image forming section 25.

This configuration will be more specifically described. The transfer section 27 transfer the sheets W along a paper transfer path (a paper transfer path provided between the registration section 5 and a paper transfer path C7 which will be described later) C3 in a direction in which the sheets W move apart from the registration section 5. The image forming section 25 forms an image on a surface (for example, the front surface)

of each sheet W by, for example, ink-jetting, and is configured of ink-jet heads HC, HK, HM, and HY, corresponding respectively to colors of cyan, black, magenta, and yellow. Each of the ink-jet heads HC, HK, HM, and HY is a full-line type head in this embodiment. However, each of ink-jet heads HC, HK, HM, and HY may be a serial type head, which forms an image while moving appropriately under the control of the controller in a direction perpendicular to the plane of FIG. 1. Alternatively, a head of another system may be employed.

The transfer section 27 includes a paper transfer conveyor 29. The paper transfer conveyor 29 includes rollers 33A, 33B, and 33C, as well as a transfer belt (a flat transfer belt) 35. The roller 33A is driven by an actuator (see FIG. 2), such as a transfer-belt driving motor 31 which is driven by control of the controller 15. The transfer belt 35 is looped around the rollers 33A to 33C. When the transfer section 27 transfers the sheets W, each sheet W is vacuum-absorbed, for example, with the transfer belt 35, and thereby is restrained by the transfer belt 35. For this reason, even when the sheet W is wet due to the formation of an image, the sheet W is unlikely to be curled.

The sheets W are transferred by use of only a planar part (the plane of the upper surface facing the ink-jet heads HC, HK, HM, and HY) of the paper transfer conveyor 29, and are thus transferred to the paper transfer path (the paper transfer path for transferring the sheets W on the same plane as the planar part of the paper transfer conveyor 29) C3. Accordingly, the sheet W having been wetted due to image formation is not bent immediately after the image formation. As a result, deformation, such as curling, of the sheets W can be prevented.

The circulating transfer unit 9 is configured to be capable of: receiving, at a predetermined position thereof, the sheets W each having an image formed thereon by the image forming unit 7; transferring the received sheets W to the registration section 5 one by one at a second transfer speed while reversing or not reversing each received sheet W. In short, each sheet W having an image formed thereon by the image forming unit 7 passes through a point P1 shown in FIG. 1 without stopping so as to be fed to the circulating transfer unit 9. Then, the sheet W is transferred by the circulating transfer unit 9.

The circulating transfer unit 9 will be described in more detail. The circulating transfer unit 9 is configured to transfer the sheets W, each having an image formed thereon by the image forming unit 7, along the paper transfer path (a circulating transfer path for sheets, which path is provided between the paper transfer path C3 and the registration section 5) C7 one by one in a direction in which the sheets W move apart from the paper transfer path C3. The circulating transfer unit 9 includes pairs of rollers 37A and 37B, 39A and 39B, 41A and 41B, 43A and 43B, 45A and 45B, 47A and 47B, 49A and 49B, as well as 51A and 51B. The rollers of each pair are in facing contact with each other.

The circulating transfer unit 9 is configured to sandwich each sheet W between each pair of rollers 37A and 37B, and the like, and to transfer the sheets W one by one by rotationally driving at least one of the rollers of each pair by an actuator, such as a motor 52 (see FIG. 2) which is driven by control of the controller 15.

When the circulating transfer unit 9 transfers the sheets W, each sheet W is transferred, for example, along the paper transfer path C7 while being sandwiched by each pair of rollers 37A and 37B, and the like. Accordingly, each sheet W is restrained by guide members (unillustrated guide members for transferring each sheet W along the paper transfer path C7) constituting the rollers 37A, 37B, and the like, as well as the paper transfer path C7. For this reason, even when the sheet W is wet due to the formation of an image, the sheet W is unlikely to be curled.

The paper discharge unit 11 is configured to discharge, one by one, the sheets W each having an image formed thereon by the image forming unit 7. The paper discharge unit 11 includes a first paper discharge section 53 and a second paper discharge section 55. The first paper discharge section 53 discharges the sheets W each having an image formed thereon by the image forming unit 7, while the second paper discharge section 55 turns upside down, and then discharges, the sheets W each having an image formed thereon by the image forming unit 7. Consider the case of performing a direct paper discharge operation (an operation in which the sheets W each having an image formed thereon by the image forming unit 7 are discharged by the paper discharge unit 11 without being circulated and transferred by the circulating transfer unit 9). In this case, the sheet W to be discharged to the first paper discharge section 53 is transferred in a state where the surface having an image formed thereon by the image forming unit 7 faces upward. On the other hand, the sheet W to be discharged from the second paper discharge section 55 is transferred in a state where the surface having an image formed thereon by the image forming unit 7 faces downward.

The first paper discharge section 53 includes, for example, a paper transfer path C5 and a paper receiving tray 57. The paper transfer path C5 diverges from the paper transfer path C3 at the middle thereof. The sheet receiving tray 57 is provided at an end (on the downstream side) of the paper transfer path C5. With this configuration, each sheet W having an image formed thereon by the image forming unit 7 is discharged to the paper receiving tray 57.

It is set by a first switching unit 59 whether or not the sheets W are discharged to the first paper discharge section 53. The first switching unit 59 is activated by control of the controller 15. Specifically, a switching claw 61 is provided at a portion where the paper transfer path C5 of the first paper discharge section 53 diverges. It is set by activating and switching the switching claw 61 whether each sheet W being transferred on the paper transfer path C3 is caused to flow to the circulating transfer unit 9 or the paper transfer path C5 of the first paper discharge section 53.

The second paper discharge section 55 diverges from the paper transfer path C7 of the circulating transfer unit 9 at the middle thereof. As in the case of the first paper discharge section 53, it is set by activating a switching claw 65 of a second switching unit 63 whether or not each sheet W is discharged to the second paper discharge section 55.

The controller 15 is configured to perform the switching control to set whether each sheet W is discharged to the first paper discharge section 53 or to the second paper discharge section 55 in accordance with conditions, such as, which side of each sheet W is caused to face upward when the sheet W is discharged by the paper discharge unit 11.

The controller 15 controls the paper feed unit 3, the registration section 5, the image forming unit 7, the circulating transfer unit 9, and the paper discharge unit 11 so as to perform the direct paper discharge operation on the sheets W each having an image formed thereon by the image forming unit 7, in accordance with the image forming conditions for the sheets W. Alternatively, the controller 15 controls the paper feed unit 3, the registration section 5, the image forming unit 7, the circulating transfer unit 9, and the paper discharge unit 11 so as to perform the circulation paper discharge operation on the sheets W each having an image formed thereon by the image forming unit 7, in accordance with the image forming conditions for the sheets W.

The direct paper discharge operation is, as has been already described, an operation in which each sheet W having an image formed thereon by the image forming unit 7 is discharged by the paper discharge unit 11 without being circulated by the circulating transfer unit 9. On the other hand, the circulation paper discharge operation is an operation performed in the following manner. Each sheet W having an image formed thereon by the image forming unit 7 is transferred by the circulating transfer unit 9, and then sent from the registration section 5. Thereafter, the sheet W is transferred again by the transfer section 27 of the image forming unit 7, and the like, without image formation by the image forming section 25 of the image forming unit 7. The sheet W is thus discharged by the paper discharge unit 11.

The circulation of the sheet W in the circulation paper discharge operation is carried out once or multiple times. Specifically, suppose a case where the circulation of the sheet W is performed once. In this case, each sheet W having an image formed thereon by the image forming unit 7 is circulated and transferred only once by the circulating transfer unit 9 to be sent from the registration section 5. Thereafter, the sheet W is discharged by the paper discharge unit 11 without image formation performed by the image forming section 25 of the image forming unit 7.

On the other hand, suppose a case where the circulation of the sheet W is performed twice. In this case, each sheet W having an image formed thereon by the image forming unit 7 is firstly circulated and transferred once by the circulating transfer unit 9 to be sent from the registration section 5. Thereafter, the sheet W is transferred once more by the transfer section 27 of the image forming unit 7 without image formation performed by the image forming section 25 of the image forming unit 7. After that, the sheet W is further circulated and transferred once by the circulating transfer unit 9 to be sent from the registration section 5. The sheet W is discharged by the paper discharge unit 11 without image formation performed by the image forming section 25 of the image forming unit 7.

The switchback section 13 is provided on the pathway of the paper transfer path C7 so as to turn upside down each sheet W transferred along the paper transfer path C7.

In the paper feed unit 3, the registration section 5, the image forming unit 7, and the circulating transfer unit 9, the transfer direction of each rectangular sheet W is substantially the same as the longitudinal direction of the sheet W, or the width direction of the sheet W. Specifically, the direction perpendicular to the plane of FIG. 1 is the same as the width direction of each sheet W, while the transfer direction of each sheet W is the same as the longitudinal direction of the sheet W. Alternatively, the direction perpendicular to the plane of FIG. 1 may be set to be the same as the longitudinal direction of each sheet W, with the transfer direction of each sheet W being set to be the same as the width direction of the sheet W.

Next, descriptions will be given of the flow of the sheet W in a case where an image is formed on the sheet W, and also where the sheet W is transferred by the circulating transfer unit 9.

FIGS. 5A to 5H are diagrams for describing the flow of the sheet W in the case where an image is formed on the sheet W, and also where the sheet W is transferred. For convenience of description, FIGS. 5A to 5H illustrate a case where only a single sheet W flows. However, during the actual operation of the image forming apparatus 1, a plurality of sheets are transferred with predetermined intervals in the image forming unit 7 or the circulating transfer unit 9.

Figure 5C:
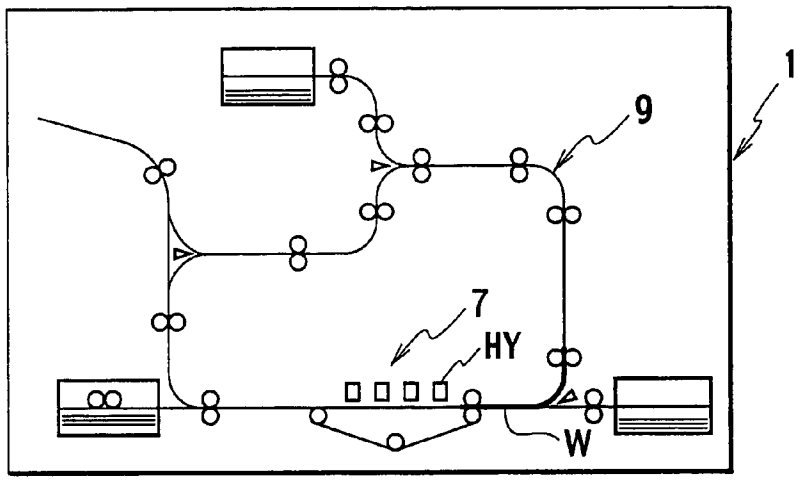
FIGS. 5A to 5H are diagrams illustrating the flow of a sheet in a case where an image is formed on the sheet, and where the sheet is transferred.
Figure 5D:
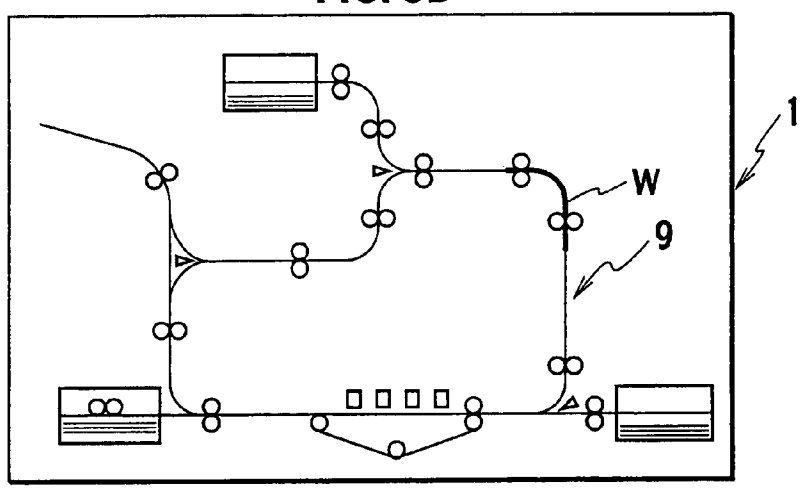
Figure 5A:
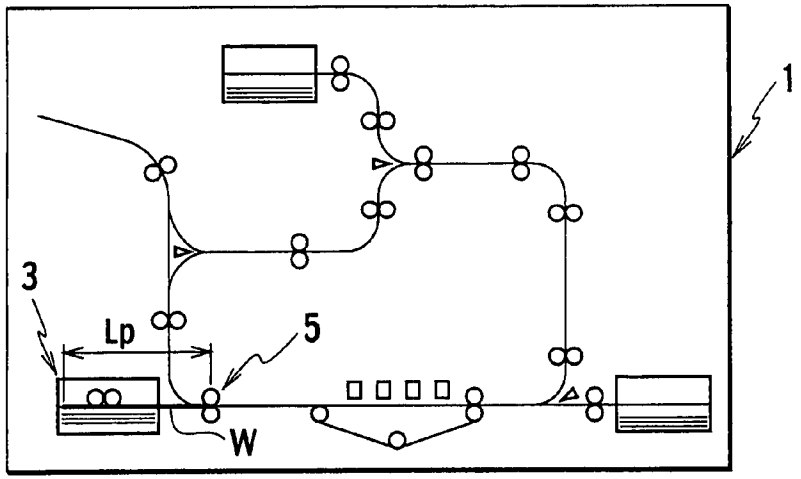
Figure 5B:
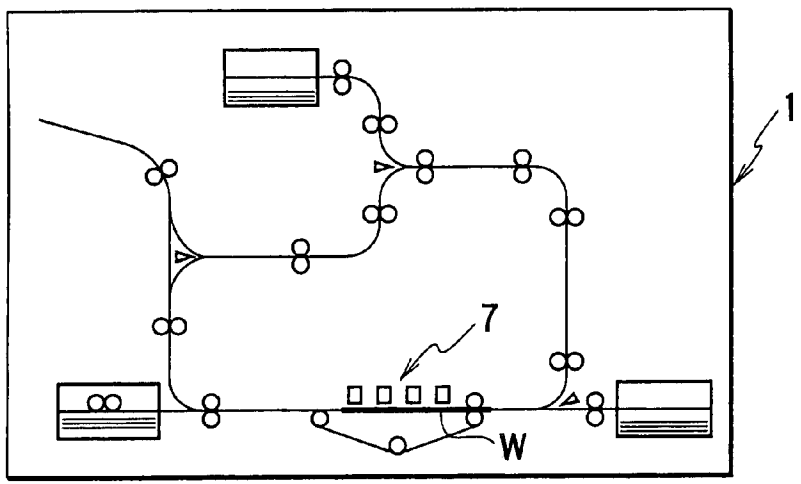

Firstly, the sheet W having a length Lp (a length in the transfer direction), which is fed from the paper feed unit 3, is sent from the registration section 5 as shown in FIG. 5A. While the sheet W is transferred at the first transfer speed, an image is formed on a surface (for example, the front surface) of the sheet W by the image forming unit 7 (refer to FIG. 5B). As shown in FIG. 5C, the sheet W is transferred at the first transfer speed immediately before or until the rear end of the sheet W passes a position below the ink-jet head HY.

Figure 5G:
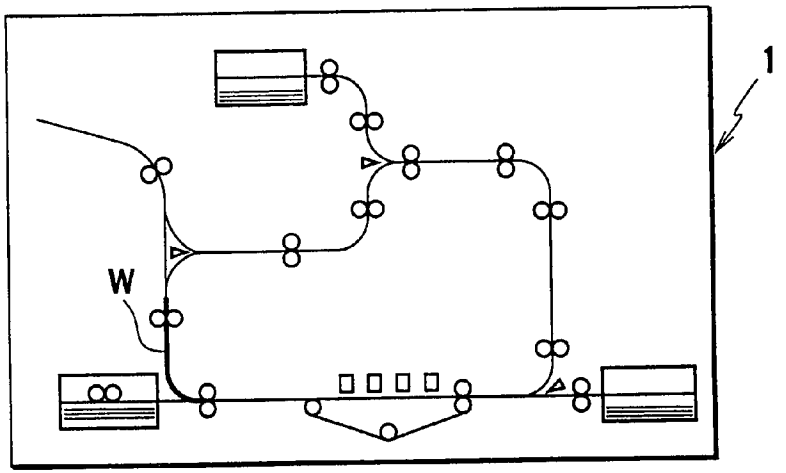
Figure 5H:
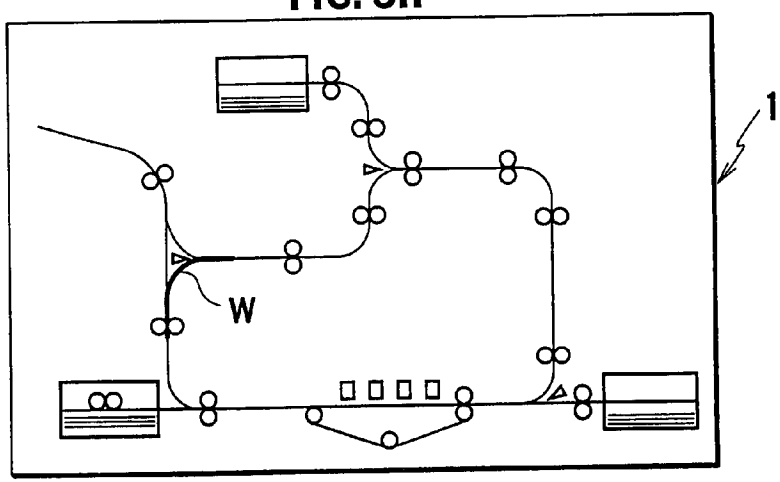
Figure 5E:
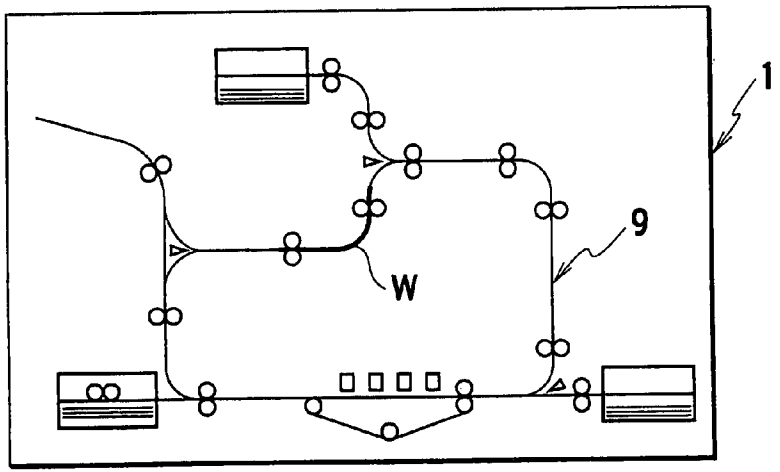
Figure 5F:
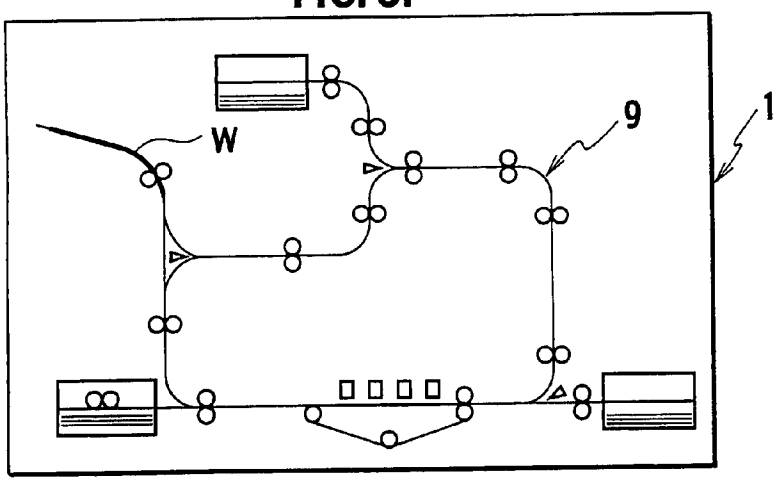

After the state shown in FIG. 5C, the transfer speed of the sheet W increases, for example, to the second transfer speed (refer to FIGS. 5D and 5E). Then, the sheet W is housed once in the switchback section 13 as shown in FIG. 5F.

Subsequently, the sheet housed in the switchback section 13 is transferred, as shown in FIG. 5G, until the front end of the sheet W reaches the registration section 5.

The circulating transfer unit 9 includes a shortcut paper transfer section (a shortcut section) 67 in parallel with the switchback section 13 on the pathway of the paper transfer path C7. While the switchback section 13 turns upside down the sheet W so that an image is formed on each of both surfaces of the sheet W, the shortcut paper transfer section 67 bypasses the switchback section 13 to shortcut. The shortcut paper transfer section 67 is provided in a vicinity of the entrance and the exit, for the sheet W, of the switchback section 13, and includes a shortcut paper transfer path C9 which bypasses the switchback section 13 to shortcut. FIG. 5H shows a state where the sheet W is passing the shortcut paper transfer section 67.

When the sheet W having an image formed on a surface thereof by the image forming unit 7 passes the switchback section 13, the sheet W is turned upside down, and then fed to the image forming unit 7. In this way, another image can be formed on the other surface of the sheet W by the image forming unit 7. In other words, using the switchback section 13 allows images to be formed on both surfaces of the sheet W. On the other hand, when the sheet W having an image formed on a surface thereof by the image forming unit 7 passes the shortcut paper transfer path C9, the sheet W is not turned upside down, and then fed to the image forming unit 7.

In this event, the controller 15 performs the switching control by using a third switching unit 69 to set whether the sheet W being transferred by the circulating transfer unit 9 is caused to pass the switchback section 13 or the shortcut paper transfer section 67 (the shortcut paper transfer path C9) in accordance with the following conditions. The conditions referred to here include: whether or not images are to be formed on both surfaces of the sheet W; which side of the sheet W is caused to face upward when the sheet W is discharged by the paper discharge unit 11; and the like. Specifically, the switching is performed by activating and switching a switching claw 71 constituting the third switching unit 69 so as to set whether the sheet W being transferred on the paper transfer path C7 is caused to pass the switchback section 13 or the shortcut paper transfer section 67.

The image forming apparatus 1 is provided with an input unit (not illustrated) and a storage unit (a printing condition look-up table (LUT)) 73. The input unit is connected through a telecommunications network to an external apparatus, such as a touch panel or a personal computer (PC). The input unit is means for inputting at least one of factors that determine the image forming conditions in the image forming unit 7. The storage unit 73 is means for storing the number of times of circulation in the circulation paper discharge operation, according to the image forming conditions in the image forming unit 7. The number of times of circulation in the circulation paper discharge operation may be "zero" in some cases. When the number of times of circulation is "zero," the direct paper discharge operation is to be executed.

The controller 15 obtains the image forming conditions in the image forming unit 7 in accordance with the factors inputted through the input unit. Using the image forming conditions thus found and the storage unit 73, the controller 15 performs control which is to be performed the direct paper discharge operation or the circulation paper discharge operation.

A condition regulating the degree of dryness of ink applied to the sheet W by ink-jetting (time supposedly taken for the ink applied to the sheet W to dry) is employed, for example, as the image forming conditions in the image forming unit 7.

The condition regulating the degree of dryness of the ink is at least one of the followings: the type of ink used for image formation (for example, the content ratio of water in the ink); the amount of ink used for image formation (for example, the maximum amount of ink used per minute unit area of the sheet W, that is, the amount of ink used in a minute surface part with the maximum amount of ink being used thereon among a plurality of minute surface parts obtained by separating the surface of the sheet W with the ink having been applied thereto); the type of sheet W used for image formation (for example, at least one condition of: the thickness of sheet W; the configuration of fibers and web of sheet W; the presence or absence of, and the type of, surface treatment performed on each sheet W); the environment in which the image forming apparatus 1 is placed (for example, at least one condition of the temperature, the humidity, and the ventilation). The surface treatment performed on the sheet W may be, for example, one for accelerating the absorption of water.

The condition regulating the degree of dryness of the ink is inputted to the controller 15 through the input unit. The types respectively of the ink and the sheet W used for image formation are inputted to the controller 15 through an input unit, such as a touch switch. Alternatively, as to the types respectively of the ink and the sheet W, the controller 15 may use stored data as default values, or may automatically obtain data using a sensor (not illustrated).

The amount of ink used for image formation is obtained by appropriately processing, with an image processing control section 75, image data received from an unillustrated external apparatus, such as a scanner or a PC, through a telecommunications network, such as the Internet. The environment where the image forming apparatus 1 is placed is inputted to the controller 15 through an input unit, such as a temperature sensor.

Suppose a case where images are substantially successively formed on a group of multiple sheets W in sequence in the circulation paper discharge operation. In this case, the controller 15 controls the timing of paper-feeding performed by the paper feed unit 3 so that the sheets W can be transferred most efficiently (for example, with a minimum space being kept between each two adjacent sheets W (hereinafter, such space will be referred to simply as a minimum sheet space)) without interference of the sheets W with each other in the transfer section 27 of the image forming unit 7.

Controlling the timing of paper-feeding performed by the paper feed unit 3 as described above allows the sheets W to be transferred most efficiently without interference of the sheets W with each other in the circulating transfer unit 9. For example, the sheets W are transferred in the circulating transfer unit 9 in such a manner that a second minimum sheet space which is larger than a first minimum sheet space in the transfer section 27 of the image forming unit 7 is maintained.

Meanwhile, suppose a case, for example, where images are formed on a group of multiple sheets W in the circulation paper discharge operation, and where the sheets W transferred by the paper transfer section of the circulating transfer unit 9 are sent from the registration section 5, and then fed to the image forming unit 7. In this case, the controller 15 controls the timing of the paper-feeding performed by the paper feed unit 3 as well as the transfer speed of the sheets W performed by the circulating transfer unit 9 so that the sheets W can be transferred most efficiently (for example, with the minimum sheet space being kept) without interference of the sheets W with each other in the transfer section 27 of the image forming unit 7.

Now, the flow of the sheets W in the image forming apparatus 1 will be described in more detail.

Figure 6A:
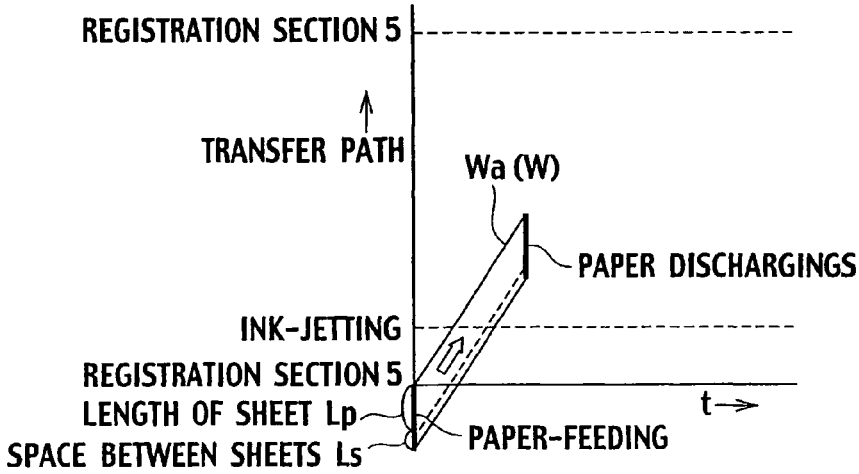
FIGS. 6A to 6C are diagrams illustrating the flow of a single sheet.
Figure 6B:
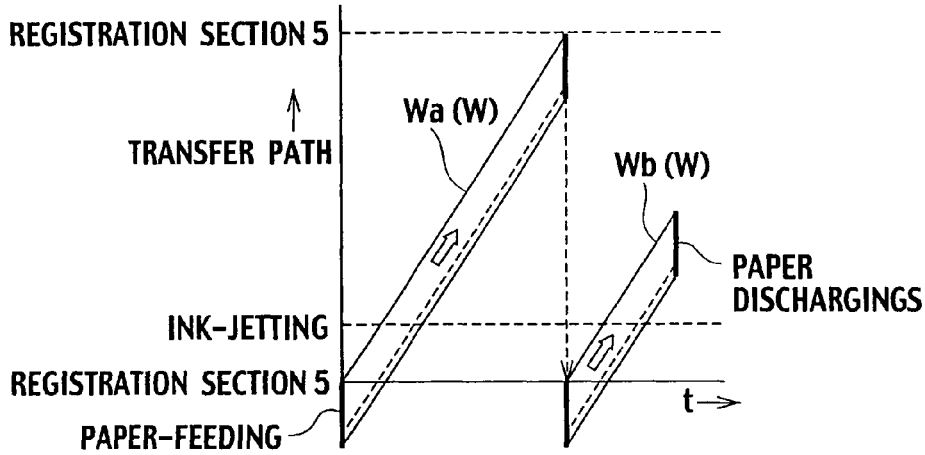
Figure 6C:
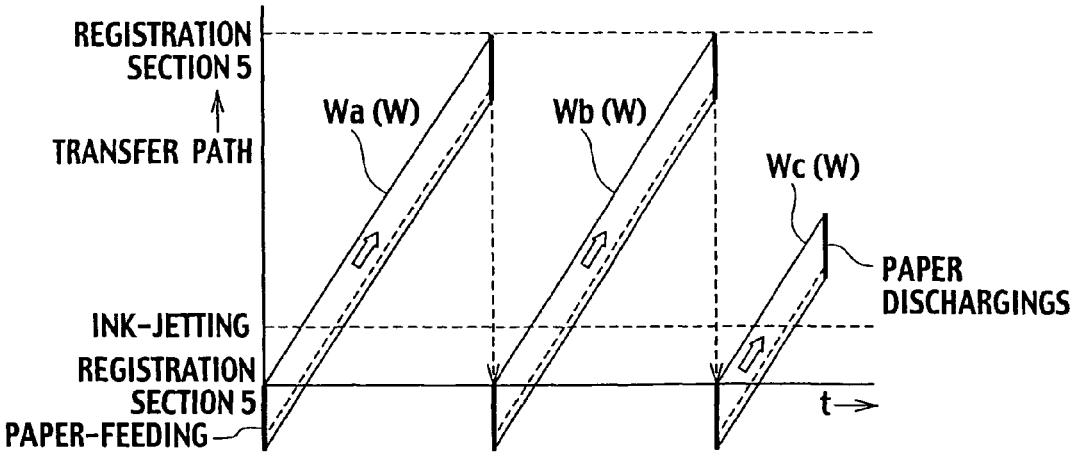

FIGS. 6A to 6C are diagrams for explaining the flow of a single sheet W.

The horizontal axis in each of FIGS. 6A to 6C shows the progression of time t, while the vertical axis therein shows the length Lp of each sheet W, the space (the space between each two sheets) Ls, or the distance of the transfer (the length of path) of each sheet W.

FIG. 6A shows a case where an image is formed on a single sheet W by the image forming unit 7, and then the direct paper discharge operation is performed without the transfer being performed by the circulating transfer unit 9. Specifically, FIG. 6A shows a case where the sheet W (Wa) having been fed flows obliquely upward as indicated by the hollow arrow in FIG. 6A so as to be discharged by the paper discharge unit 11.

FIG. 6B shows a case where an image is formed on a single sheet W by the image forming unit 7, and then the circulation paper discharge operation is performed once by the circulating transfer unit 9. Specifically, the sheet W (Wa) having been fed flows obliquely upward as indicated by the hollow arrow in FIG. 6B. Then, once reaching the registration section 5 shown on the upper side of FIG. 6B, the sheet Wa moves to the registration section 5 shown on the lower side of FIG. 6B. After that, the sheet W (Wb: the same sheet as the sheet Wa) flows obliquely upward as indicated by the hollow arrow in FIG. 6B so as to be discharged by the paper discharge unit 11. Since the transfer path of the sheet W is formed in an annular shape, the registration section 5 shown on the upper side of FIG. 6B and the registration section 5 shown on the lower side of FIG. 6B are the same registration section 5.

FIG. 6C shows a case where an image is formed on a single sheet W by the image forming unit 7, and then the circulation paper discharge operation is performed twice by the circulating transfer unit 9. The case shown in FIG. 6C can be considered to be the same as that shown in FIG. 6B except that the sheet Wc (which is the same as the sheet Wa and the sheet Wb) is added to FIG. 6C.

Figure 7:
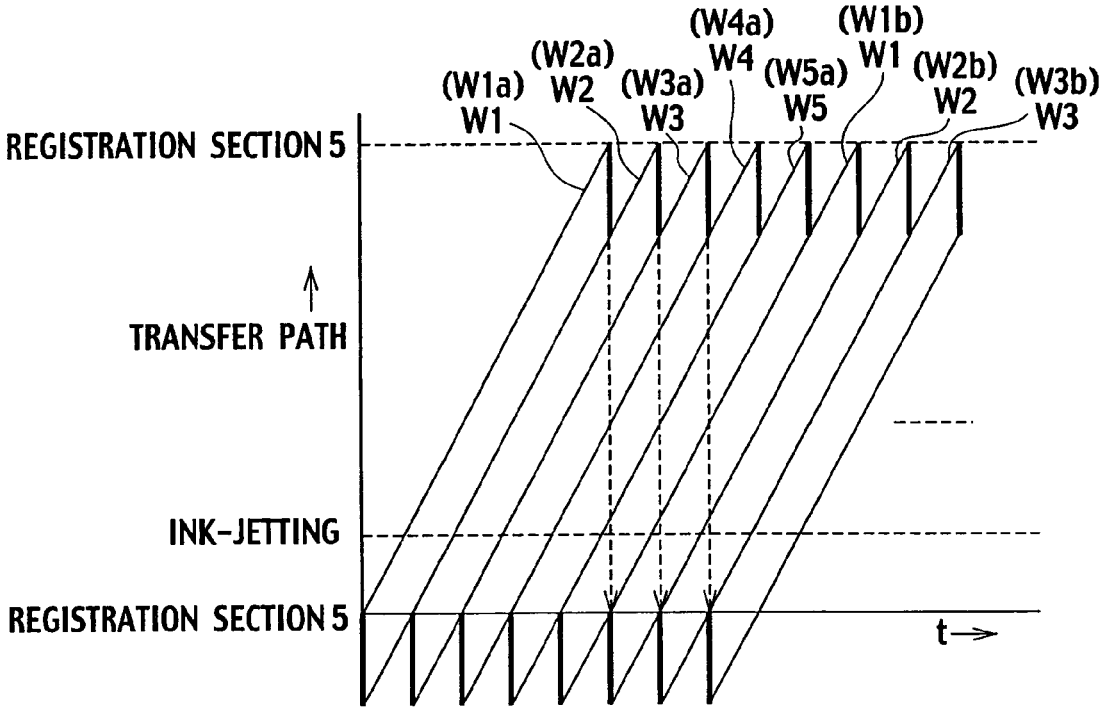
FIG. 7 is a diagram showing a case where images are formed, by an image forming unit, sequentially on a group of five sheets, and where a circulation paper discharge operation is performed.

FIG. 7 shows a case where images are formed on a group of five sheets W (W1 to W5) in sequence by the image forming unit 7, and also the circulation paper discharge operation is performed. The horizontal and vertical axle in FIG. 7 show the progression of time t, the distance of the transfer of each sheet W, and the like, as in the cases of FIGS. 6A to 6C. In FIGS. 7 to 10, the sheet space Ls is not shown. Note that, the five sheets W (W1 to W5) are fed, with predetermined proper sheet spaces, to the annular transfer path formed by the image forming unit 7 and the circulating transfer unit 9. The number of sheets W to be fed to the annular transfer path varies depending on the size Lp of each sheet W. In addition, when the number of sheets to be fed to the annular transfer path is a number with a fractional part, such as 5.4, the fractional part is truncated, so that the number of sheets to be fed to the annular transfer path is set to be five.

Firstly, the sheet W1 (W1*a*) is fed to the registration section 5, and then transferred. Then, the paper feeding is sequentially performed by the paper feed unit 3 (refer to the sheet W2 (W2*a*), the sheet W3 (W3*a*), the sheet W4 (W4*a*), and the sheet W5 (W5*a*), in FIG. 7) in such a manner that the sheets W can be transferred most efficiently without interference of the sheets W with each other in the transfer section 27 of the image forming unit 7.

Next, each of the sheets W1 (W1*a*) to W5 (W5*a*) having been sequentially fed reaches the registration section 5 shown on the upper side, and then move to the registration section 5 shown on the lower side, in a sequential manner. Thereafter, the sheets W1 (W1*b*) to W5 (W5*b*) are transferred in sequence.

FIGS. 6A to 6C, and FIG. 7 are illustrations for facilitating the understanding of the flow of the sheets W.

Here, by providing an example, descriptions will be given of the flow of the sheets W in a case where the timing of paper-feeding by the paper feed unit 3, and the like, are controlled as described above (controlled so that the sheets W can be transferred most efficiently without interference of the sheets W with each other in the transfer section 27 of the image forming unit 7).

Figure 8:
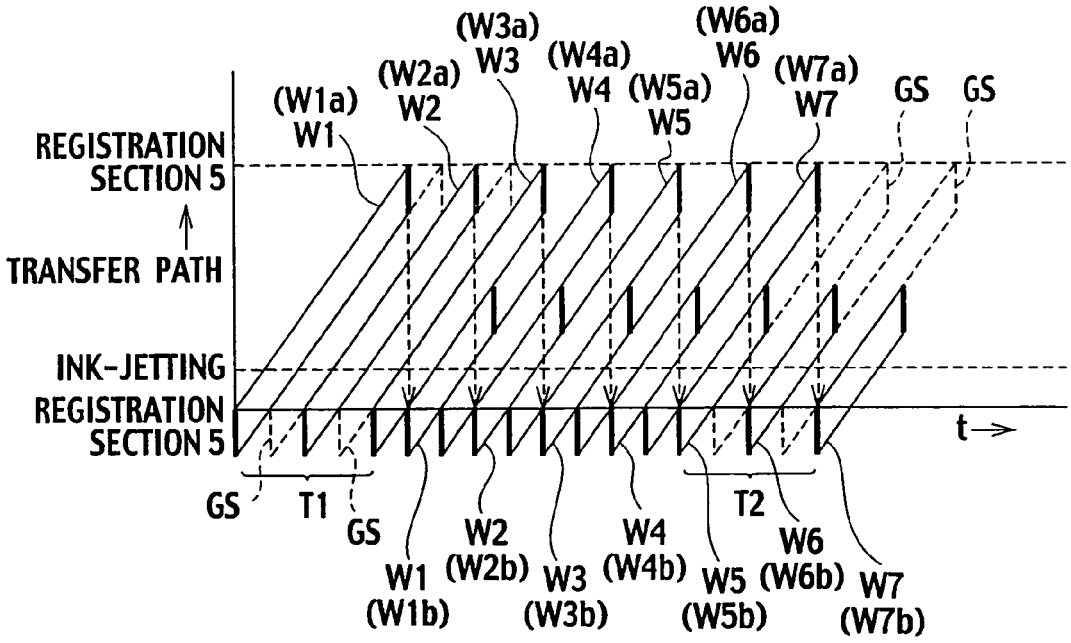
FIG. 8 is a diagram showing a case where images are formed, by the image forming unit, on a group of seven sheets, and where the circulation paper discharge operation is performed once by a circulating transfer unit.

FIG. 8 shows a case where images are formed on a group of seven sheets W1 to W7 by the image forming unit 7, and also where the circulation paper discharge operation is performed once by the circulating transfer unit 9.

In the beginning, first three sheets W1 (W1*a*), W2 (W2*a*), and W3 (W3*a*) are fed by the paper feed unit 3 with predetermined gaps GS (an interval allowing a single sheet W to be circulated and transferred therein). In this manner, the sheets W are transferred at the gaps GS by the transfer section 27 of the image forming unit 7. Next fourth to seventh sheets W4 (W4*a*), to W7 (W7*a*) are also fed by the paper feed unit 3 at the predetermined gap GS. However, since the sheets W1 (W1*b*) to W4 (W4*b*) having been circulated once are placed each in a corresponding space in between the sheets, the sheets W3 (W3*a*) to W5 (W5*b*) are transferred by the transfer section 27 of the image forming unit 7 in the most efficient manner without interference of the sheets W with each other. As already understood, the sheets W5 (W5*b*) to W7 (W7*b*) are transferred with the predetermined gaps GS by the transfer section 27 of the image forming unit 7.

The paper-feeding state of the sheets W shown in FIG. 8 is described as the "first circulation (refer to the vertical row thereof)" shown in FIG. 4. Specifically, an operation as described below is performed. Firstly, the sheet W1 is fed from the paper feed unit 3 to be transferred at "1" in the "first circulation. " Then, the sheet W2 is fed from the paper feed unit 3 to be transferred at "2" after the predetermined gap GS. Sequentially, the sheet W3 is fed from the paper feed unit 3 to be transferred at "3" after the predetermined gap GS. After that, the sheet W1 having been circulated once by the circulating transfer unit 9 is fed to be transferred without the predetermined gap GS. Thereafter, the sheet W4 is fed from the paper feed unit 3 at "4" without the predetermined gap GS . . . .

Figure 9:
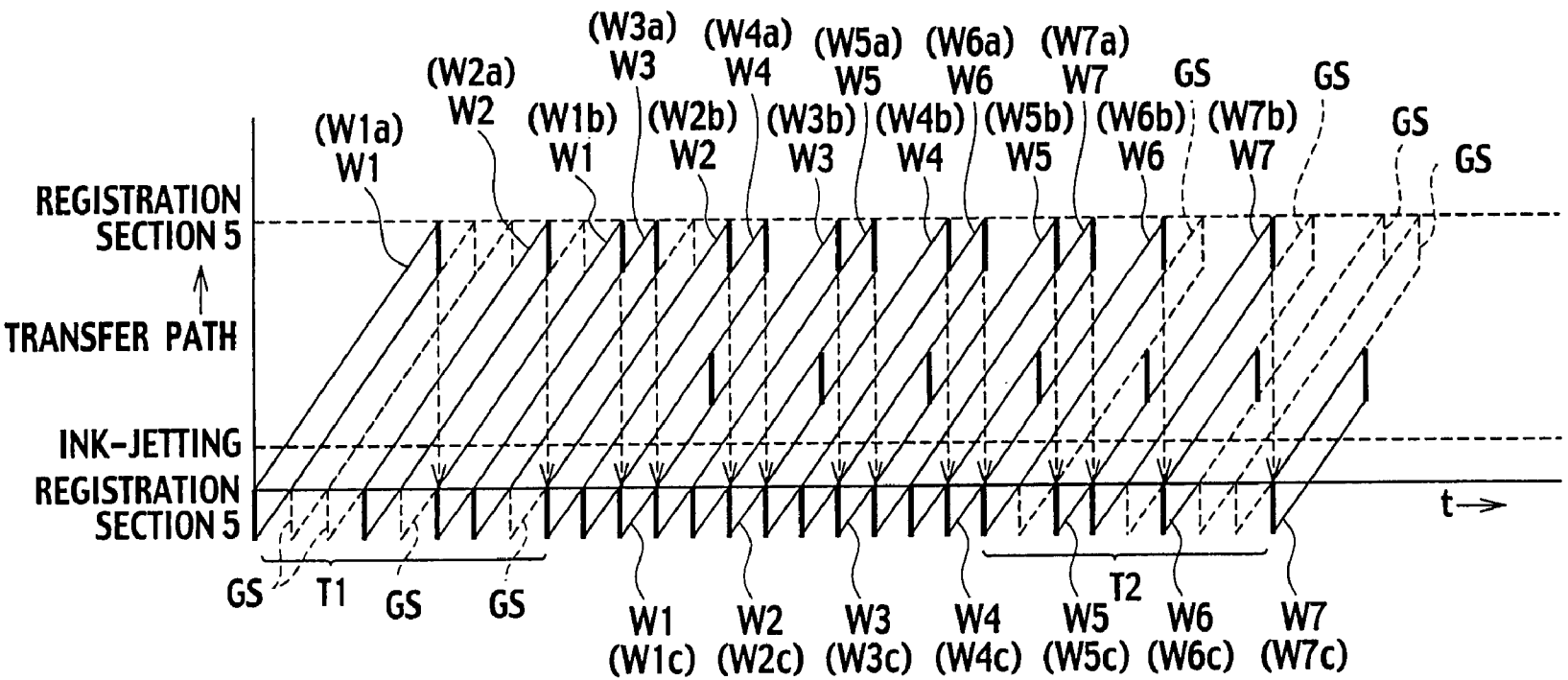
FIG. 9 is a diagram showing a case where images are formed on a group of seven sheets, by the image forming unit, and where the circulation paper discharge operation is performed twice by the circulating transfer unit.

FIG. 9 shows a case where images are formed on a group of seven sheets W1 to W7 by the image forming unit 7, and also where the circulation paper discharge operation is performed twice by the circulating transfer unit 9.

The sheets W1 (W1*a*) to W7 (W7*a*) are fed by the paper feed unit 3 at intervals each of which is two times of the predetermined gap GS (corresponding to two sheets). It should be noted that, however, since the sheets having been transferred by the circulating transfer unit 9 are appropriately placed each in a corresponding space in between the sheets, the sheets W2 (W2*b*) to W6 (W6*b*) are transferred by the transfer section 27 of the image forming unit 7 in the most efficient manner without interference of the sheets W with each other. The paper-feeding state of the sheets W shown in FIG. 9 is described as the "second circulation (refer to the vertical row thereof)" shown in FIG. 4.

Figure 10:
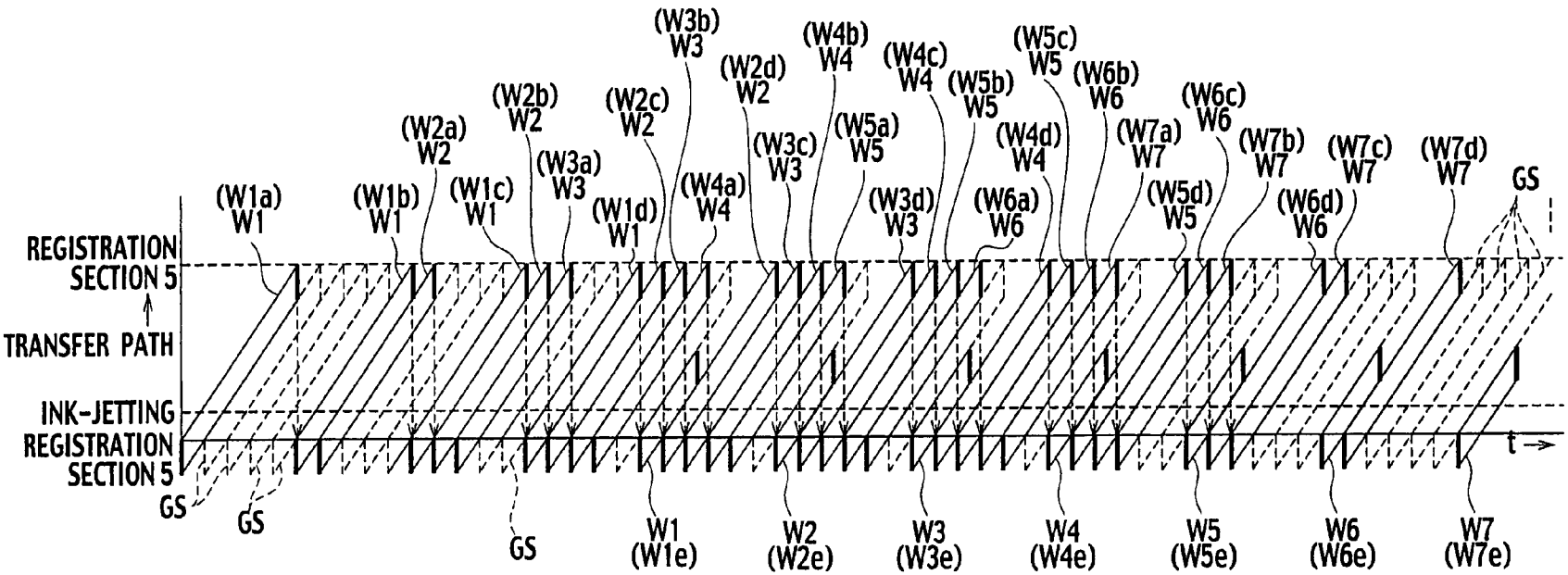
FIG. 10 is a diagram showing a case where images are formed on a group of seven sheets, by the image forming unit, and where the circulation paper discharge operation is performed four times by the circulating transfer unit.

FIG. 10 shows a case where images are formed on a group of seven sheets W1 to W7 by the image forming unit 7, and also where the circulation paper discharge operation is performed four times by the circulating transfer unit 9.

The operation shown in FIG. 10 can be understood in the same manner as the cases shown in FIGS. 8 and 9. It should be noted that, however, the paper-feeding timing of the sheet W2 (W2*a*) is delayed so that the sheet W2 does not overlap the sheet W1 (W1*b*). Accordingly, the predetermined gap GS exists, for example, between the sheets W5 (W5*a*) and W2 (W2*e*).

In FIGS. 8 to 10, it is supposed that an image is formed only on a surface of each of the sheets W. It is also possible to consider, in the same manner, a case where images are formed on both surfaces of each of the sheets W, and also where the circulation paper discharge operation is performed. Specifically, for example, in FIG. 10, an image is formed on a surface of the sheet W1 at a timing corresponding to the sheet W1 (W1*a*), and then another image is formed on the other surface of the sheet W1 at a timing corresponding to the sheet W1 (W1*c*). In this manner, after the images are formed on the sheet W1, the sheet W1 is circulated for an appropriate number of times.

Think more about the case where images are formed on both surfaces of each sheet W as described above. In this case, the number of times of circulation performed after an image is formed on a surface of the sheet W, and the number of times of circulation performed after another image is formed on the other surface of the sheet W may be the same as each other, or may be different from each other.

For example, consider a case where it is found out, from the result obtained from the image forming conditions, that a first surface (the front surface) of the sheet W will dry slower than a second surface (the back surface) of the sheet W. In such case, the number of times of circulation after a first image is formed on the first surface of the sheet W (after the first image is formed on the front surface of the sheet W) may be set larger than the number of times of circulation after a second image is formed on the second surface of the sheet W (after the second image is formed on the back surface of the sheet W). In this way, the second image is formed on the second surface of the sheet W after the sheet W sufficiently dries with the first image formed on the first surface of the sheet W. In addition, after the second image is formed on the second surface, which has been determined to dry earlier, of the sheet W, the sheet W is discharged quickly. Accordingly, the image formation on the sheet W (particularly on the second surface of the sheet W) can be efficiently performed.

When images are formed on a group of multiple sheets W in the circulation paper discharge operation under the control of the controller 15, the number of times of circulation for each sheet W is determined as follows. Specifically, the number of times of circulation required for a sheet W having the worst degree of dryness of the ink among the sheets W is set to be the number of times of circulation for each sheet W in the circulation paper discharge operation.

Hereinafter, the operation of the image forming apparatus 1 will be described.

Figure 3:
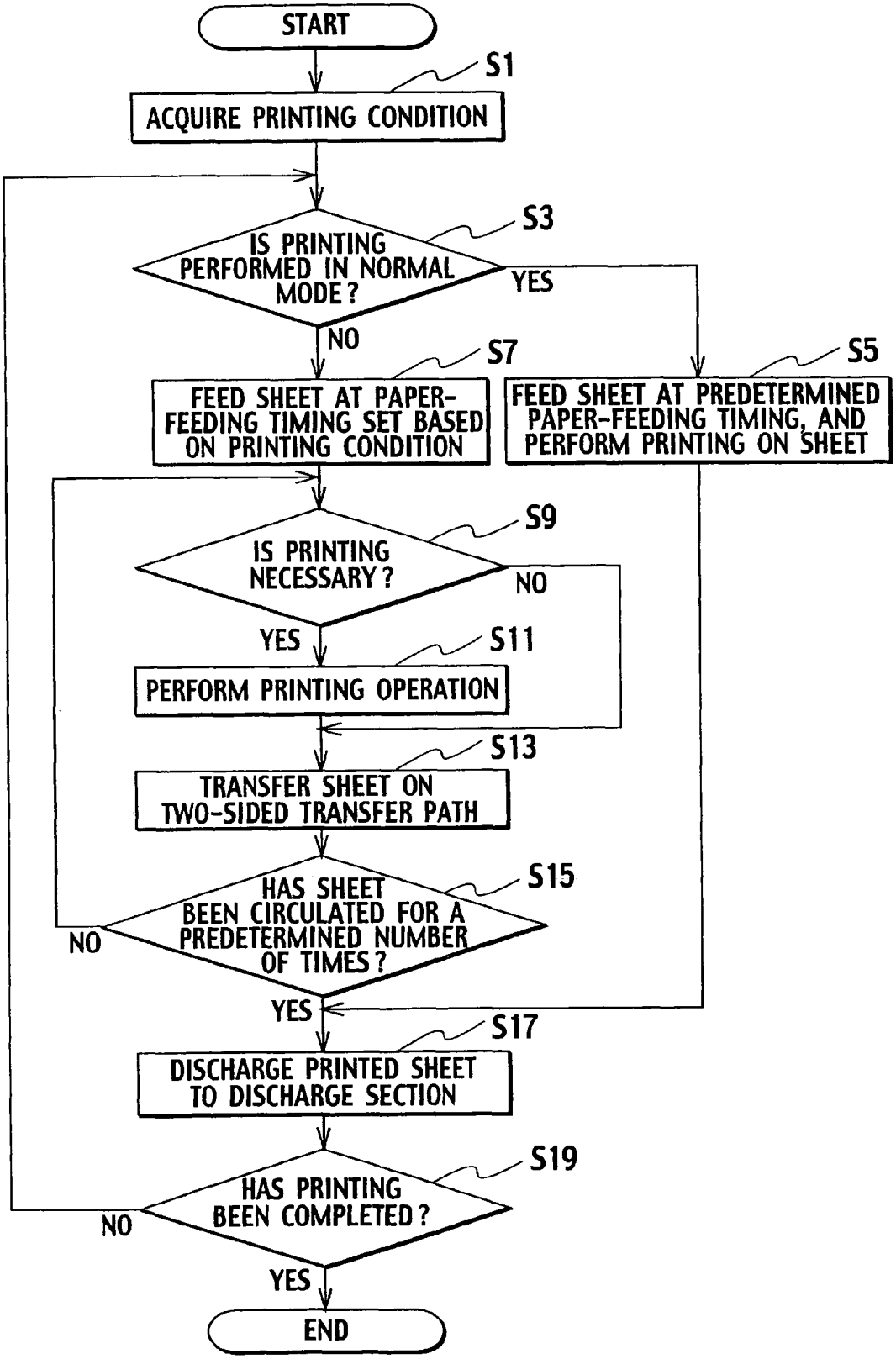
FIG. 3 is a flowchart showing the operation of the image forming apparatus.

FIG. 3 is a flowchart showing the operation of the image forming apparatus 1.

Firstly, the image forming apparatus 1 acquires a printing condition under the control of the controller 15 (S1), and then determines whether or not the printing is to be performed in a normal mode (which is to be performed the direct paper discharge operation or the circulation paper discharge operation) (S3).

When printing is to be performed in the normal mode ("YES" in S3), sheets are fed at a predetermined paper-feeding timing (S5). For example, sheets are fed, and images are formed on the sheets, as shown in the vertical row indicated by "predetermined one surface" shown in FIG. 4. After that, the sheets are discharged by the paper discharge unit 11 (S17).

On the other hand, when printing is to be performed not in the normal mode ("NO" in S3), sheets are fed at a paper feeding timing which is set based on the printing condition (S7). When printing on the sheet W is necessary (S9), the printing is performed on the sheet W by the image forming unit 7 (S1), and thereafter, the sheet W is transferred by the circulating transfer unit 9 (S13). When printing on the sheet W is unnecessary (S9), the sheet W is transferred as it is by the circulating transfer unit 9 (S15).

Subsequently, it is determined whether or not the sheet W has been circulated for a predetermined number of times (S15). When the sheet W has not yet been circulated for the predetermined number of times, the process returns to Step S9. On the other hand, when the sheet W has already been circulated for the predetermined number of times, the sheet W is discharged by the paper discharge unit 11 (S17). When the printing is completed for the group of the sheets W (S19), the image forming apparatus 1 terminates the operation. When the printing has not been completed for the group of the sheets W (S19), the process returns to Step S3.

According to the image forming apparatus 1, the sheets W each having an image formed thereon by the image forming unit 7 are received at the predetermined position. Then, the received sheets W are transferred one by one to the registration section 5 by the circulating transfer unit 9, and thereafter discharged. Accordingly, the curling of the sheets W each having an image formed thereon can be prevented with a simple configuration.

Specifically, as is clear from the configuration shown in FIG. 1, the sheets W each having an image formed thereon by the image forming unit 7 are received at the predetermined position, and the sheets W are transferred and dried by utilizing the paper transfer path C7, which is used when images are to be formed on both surfaces of the sheet W. Accordingly, the sheets W can be dried with the simple configuration, without a mechanism being provided for drying the sheets W. As a result, the curling of the sheets W each having the image formed thereon can be prevented. In addition, it is possible to prevent misalignment of the sheets W on the discharge sections 53 and 55, and therefore to ensure a favorable paper discharge operation.

In the case of the image forming apparatus described in Japanese Patent Application Publication No. 2006-264828, when a slow-drying ink or a sheet which does not quickly dry is used, the sheet may possibly be insufficiently dried. By contrast, according to the image forming apparatus 1, a sheet W having an image formed thereon can be transferred at a distance sufficiently longer than that of the image forming apparatus described in the Japanese Patent Application Publication No. 2006-264828. For this reason, even when a slow-drying ink or a sheet which does not quickly dry is used, it is possible to sufficiently dry the sheet W having an image formed thereon, and to thus prevent the sheet W from curling.

According to the image forming apparatus 1, when images are formed substantially successively on a group of multiple sheets W in sequence in the circulation paper discharge operation, the timing of paper-feeding by the paper feed unit 3 is controlled so that the sheets W can be transferred most efficiently without interference of the sheets W with each other in the transfer section 27 of the image forming unit 7. Accordingly, a favorable printing operation can be performed without a reduction in the throughput (printing efficiency).

The image forming apparatus 1 includes the shortcut paper transfer section 67 which bypasses the switchback section 13 to shortcut. Accordingly, it is possible to control which surface of each sheet W to be discharged to the paper discharge unit 11 is caused to face upward, regardless of the number of times of circulation of the sheet W in the circulation paper discharge operation, and also no matter whether the sheet is to be discharged to the first discharge section 53 or the second discharge section 55.

In the case where images are formed on a group of multiple sheets W in the circulation paper discharge operation, the sheets (printed sheets) W each having the image formed thereon can be discharged in the correct order.

Specifically, suppose the following case. Images are formed on a group of multiple sheets W in the circulating paper discharge operation in which each sheet W is circulated once. Moreover, the image is formed on only a surface of each sheet W, and the sheets W are discharged to the first discharge section 53. In this case, the sheets W may be circulated so as to pass the switchback section 13. In this way, the sheets W are discharged to the first discharge section 53 in such a manner that the surface, having the image formed thereon, of each sheet W is caused to face downward, and that a second sheet W is discharged to overlap a first sheet W. In this way, the printed sheets are discharged in the correct order.

On the other hand, suppose the following case. Images are formed on a group of multiple sheets W in the circulation paper discharge operation in which each sheet W is circulated twice. Moreover, the image is formed on only a surface of each sheet W, and the sheets W are discharged. In this case, the sheets W may be circulated in such a manner that each sheet W is caused to pass the switchback section 13 in one of the two times of circulation, and that each sheet W is caused to pass the shortcut paper transfer section 67 in the other one of the two times of circulation. The sheets W are thus discharged to the first discharge section 53 in such a manner that the surface, having the image formed thereon, of each sheet W is caused to face downward, and that a second sheet W is discharged to overlap a first sheet W. In this way, the printed sheets are discharged in the correct order.

According to the image forming apparatus 1, it is possible to determine whether or not the circulation paper discharge operation is performed, and also to determine the number of times of circulation for sheets in the case of performing the circulation paper discharge operation, in accordance with the temperature, and the like, of the environment where the image forming apparatus 1 is placed. As a result, a favorable image formation can be more efficiently performed than otherwise.

According to the image forming apparatus 1, the following effects can also be achieved. Specifically, when images are formed on a group of multiple sheets W in the circulation paper discharge operation, the number of times of circulation required for a sheet W having the worst degree of dryness of the ink among the sheets W is set to be the number of times of circulation for each sheet W in the circulation paper discharge operation. Accordingly, the sheets W each having the image formed thereon can be discharged after being securely dried without a complicated control being performed.

(Second Embodiment)

An image forming apparatus according to a second embodiment is different from the image forming apparatus 1 according to the first embodiment in that the gap GS shown in FIGS. 8 to 10 is not provided. The image forming apparatus according to the second embodiment is configured, as to the other points, in the same manner as the case of the image forming apparatus 1 according to the first embodiment, and thus provides substantially the same effects as the image forming apparatus 1.

Specifically, consider a case where images are formed on a group of multiple sheets W in the circulation paper discharge operation in the image forming apparatus according to the second embodiment. In this case, a controller of the image forming apparatus controls the transfer speed of the sheets W transferred by the circulating transfer unit 9 so that the sheets W can be transferred most efficiently (for example, with a minimum sheet space) without interference of the sheets W with each other in the transfer section 27 of the image forming unit 7, after the paper feed unit 3 starts the paper-feeding, and until the sheets W having been transferred by the circulating transfer unit 9 are sent from the registration section 5 to eventually start to be fed to the image forming unit 7 (in other words, when the sheets W having been transferred by the circulating transfer unit 9 have not yet been fed to the image forming unit 7 in the case where images are formed successively on the multiple sheets W in the circulation paper discharge operation; or at the beginning in a case where images are formed successively on the multiple sheets W) [0].

Moreover, consider the case where images are formed on a group of multiple sheets W in the circulation paper discharge operation in the image forming apparatus according to the second embodiment. In this case, the controller of the image forming apparatus controls the transfer speed of the sheets W transferred by the circulating transfer unit 9 so that the sheet W can be transferred most efficiently (for example with a minimum sheet space) without interference of the sheets W with each other in the transfer section 27 of the image forming unit 7, after the paper feed unit 3 completes the paper-feeding, and while the sheets W having been transferred by the circulating transfer unit 9 are being sent from the registration section 5 to be being fed to the image forming unit 7 (that is, when the paper-feeding performed by the paper feed unit 3 has been completed, but the sheets W being transferred by the paper transfer section of the circulating transfer unit 9 are still being fed to the image forming unit 7 in the case where images are formed successively on the multiple sheets W in the circulation paper discharge operation; or in short, near the end in the case where images are formed successively on the multiple sheets W).

The above-described controls make it possible to eliminate, or reduce to the minimum, the predetermined gap GS shown in FIGS. 8 to 10. Specifically, the time T1 and the time T2 shown in FIGS. 8 and 9 can be reduced to be lower than those shown in FIGS. 8 and 9.

In the image forming apparatus according to the second embodiment, the transfer speed of the sheets W transferred by the circulating transfer unit 9 is controlled so that the sheets W can be transferred most efficiently without interference of the sheets W with each other in the transfer section 27 of the image forming unit 7 after the start and near the end of the operation in the case where images are formed successively on multiple sheets W. In other words, as described above, since the part of gap GS (a blank part where a sheet is not fed) shown in FIG. 8 is eliminated, images can be formed more efficiently on the sheets W.

The image forming apparatus according to each of the above-described embodiments is an example of an image forming apparatus configured as follows. Specifically, a sheet having an image formed on one surface (for example, the front surface) thereof is received at a predetermined position thereof. Then, the received sheet is transferred on a circulating transfer path (for example, a two-sided transfer path capable of turning upside down the sheet by means of the switchback section). After this transfer, another image is formed on the other surface (for example, the back surface) of the sheet. In this manner, this image forming apparatus can form images on both surfaces of the sheet. Moreover, the image forming apparatus is configured also to utilize the circulating transfer path for securing time taken for the sheet having an image formed thereon to dry.

The image forming apparatus according to the embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. An image forming apparatus comprising:

a paper feed unit configured to feed sheets of sheet media stored in a paper storage section one by one to a registration section;

an image forming unit including an image forming section and a transfer section, and configured to form an image on a surface of each of the sheets by using the image forming section, while transferring the sheets one by one by using the transfer section, the image forming unit receiving sheets fed by the paper feed unit and then sent from the registration section;

a circulating transfer unit configured to transfer the sheets each having an image formed on each sheet by the image forming unit to the registration section one by one;

a paper discharge unit configured to discharge the sheets each having an image formed on each sheet by the image forming unit one by one; and a control unit configured to control whether to perform any one of a direct paper discharge operation and a circulation paper discharge operation in accordance with an image forming condition for the sheets by selectively causing the circulating transfer unit to transfer the sheets a number of times of circulation, for each printed side of the sheets, selected in accordance with the image forming condition for the sheets, whereby, in the direct paper discharge operation, the paper discharge unit discharges the sheets each having an image formed on each sheet by the image forming unit without circulation by the circulating transfer unit, and in the circulation paper discharge operation, after transfer by the circulating transfer unit, the transfer section of the image forming unit again transfers the sheets each having an image formed on each sheet by the image forming unit without performing image formation by the image forming section of the image forming unit, followed by discharge of the sheets by the paper discharge unit.

2. The image forming apparatus according to claim 1, wherein:

the circulating transfer unit transfers a sheet having an image formed on a first surface of the sheet along a circulating transfer path; and the image forming unit forms another image on a second surface of the sheet after the transfer, the control unit selectively causes the circulating transfer unit to transfer the sheets a number of times of circulation to secure time taken for the sheet having an image formed on the sheet to dry.

3. The image forming apparatus according to claim 1, wherein the circulating transfer unit includes a paper transfer section, and upon images being formed on a group of a plurality of sheets in the circulation paper discharge operation, the control unit controls a timing of paper-feeding performed by the paper feed unit, so that the sheets are transferred efficiently without interference of the sheets with each other in the transfer section of the image forming unit, when the sheets having been transferred by the paper transfer section of the circulating transfer unit are fed to the image forming unit.

4. The image forming apparatus according to claim 3, wherein upon the images being formed on the group of the plurality of sheets in the circulation paper discharge operation, the control unit controls a timing of paper-feeding performed by the paper feed unit, so that the sheets are transferred efficiently without interference of the sheets with each other in the transfer section of the image forming unit, after a start of the paper-feeding by the paper feed unit, and until the sheets having been transferred by the circulating transfer unit start to be fed to the image forming unit.

5. The image forming apparatus according to claim 3, wherein upon the images being formed on the group of the plurality of sheets in the circulation paper discharge operation, the control unit controls a transfer speed of the sheets transferred by the circulating transfer unit, so that the sheets are transferred efficiently without interference of the sheets with each other in the transfer section of the image forming unit, after a completion of the paper-feeding by the paper feed unit, and while the sheets having been transferred by the circulating transfer unit are fed to the image forming unit.

6. The image forming apparatus according to claim 1, wherein the circulating transfer unit includes:

a switchback section on a way of the paper transfer section, the switchback section being configured to turn upside down each sheet so that an image is formed on each of both surfaces of the sheet; and a shortcut paper transfer section in a vicinity of an entrance and an exit, for the sheets, of the switchback section, the shortcut paper transfer section bypassing the switchback section to shortcut when causing the circulating transfer unit to transfer the sheets a number of times of circulation in order to permit circulation of the sheets without turning the sheets upside down.

7. The image forming apparatus according to claim 1, wherein the image forming unit performs the image formation by ink-jetting; and the image forming condition in the image forming unit is a condition regulating a degree of dryness of ink transferred onto the sheets by the ink-jetting.

8. The image forming apparatus according to claim 7, wherein upon images being formed on a group of a plurality of sheets by the circulation paper discharge operation, a number of times of circulation required for a sheet having a worst degree of dryness of the ink among the sheets is set to be a number of times of circulation for each sheet in the circulation paper discharge operation.

9. The image forming apparatus according to claim 1, further comprising the control unit configured to independently control a number of times of circulation performed on according to dryness of ink applied to each of the printed sides of the sheets.

10. The image forming apparatus according to claim 1, wherein the image forming condition comprises a degree of dryness of ink applied to the printed sides of the sheets.

11. The image forming apparatus according to claim 10, wherein the image forming condition comprising regulating the degree of dryness of the ink comprises at least one of:

a type of ink used for image formation, an amount of ink used for image formation, a type of sheet media used for image formation, the environmental conditions of the image forming apparatus, consisting of at least one of temperature, humidity and ventilation, and a surface treatment performed on the sheet media.

* * * * *